US006929347B2

(12) United States Patent
Ara

(10) Patent No.: US 6,929,347 B2
(45) Date of Patent: Aug. 16, 2005

(54) INK JET PRINTING APPARATUS AND WIPING METHOD THEREFOR

(75) Inventor: Yohji Ara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 237 days.

(21) Appl. No.: 10/127,592

(22) Filed: Apr. 23, 2002

(65) Prior Publication Data

US 2002/0171707 A1 Nov. 21, 2002

(30) Foreign Application Priority Data

Apr. 24, 2001 (JP) ..... 2001-126396

(51) Int. Cl.[7] ..... B41J 2/165
(52) U.S. Cl. ..... 347/33
(58) Field of Search ..... 347/22, 24, 29, 347/33; 15/250.361, 256.5; 101/155

(56) References Cited

U.S. PATENT DOCUMENTS 5,943,071 A * 8/1999 Premnath ..... 347/33
6,213,582 B1 4/2001 Uchida ..... 347/33
6,231,157 B1 * 5/2001 Saijo ..... 347/33

FOREIGN PATENT DOCUMENTS

JP 406071904 A * 3/1994 ..... 347/33
JP 7-223321 8/1995

* cited by examiner

*Primary Examiner*—Shih-Wen Hsieh
(74) *Attorney, Agent, or Firm*—Fitzpatrick, Cella, Harper & Scinto

(57) ABSTRACT

In printing with black ink ejected through ejection openings of a corresponding ejection opening array of a printing head for reacting with other color inks ejected through ejection openings of color ejection opening arrays, during wiping, the respective ejection opening arrays or the group of ejection opening arrays and the vicinities thereof are wiped using two blades corresponding to the black and other color ejection opening arrays, respectively, and each forming a predetermined angle with respect to a direction orthogonal to a wiping direction. Thus, the wiped-away ink or the like is collected in a portion between the black ejection opening array and the color ejection opening arrays so as to be away from the corresponding ejection opening arrays, and is then wiped by another blade.

9 Claims, 5 Drawing Sheets

INK JET PRINTING APPARATUS AND WIPING METHOD THEREFOR

This application is based on Patent Application No. 2001-126396 filed Apr. 24, 2001 in Japan, the content of which is incorporated hereinto by reference.

BACKGROUND OF THE INVENTION

1. Field of the Invention

The present invention relates to an ink jet, printing apparatus and a wiping method therefor, and more specifically, to the construction of a blade used for a wiping operation performed as one of processes for maintaining the ejection performance of a printing head from which ink is ejected.

2. Description of the Related Art

Ink jet printing apparatuses have the advantages of low noise, low running costs, an easy reduction in size of the apparatus, easy introduction of various colors, and the like, and are applied to printers, facsimile terminal equipment, copy machines, and the like.

A printing head used in such an apparatus includes ejection openings as openings through which ink is ejected. In general, according to an ejection signal based on print data transmitted by a host apparatus such as a personal computer, the ink jet printing apparatus drives the printing head to eject ink droplets through the ejection openings. The size of these ejection openings, if they are, for example, circular, is such that their diameter is about several tens of $\mu$m, and tends to be reduced in order to improve the quality of images to be printed or the like. Thus, the ejection openings have been more and more densely arranged.

Since the ink jet system-based printing apparatus causes ink to be ejected through these fine ejection openings, the ejection openings are prone to be blocked, and the range within which the fluidity (viscosity) of the ink may vary is relatively small. Thus, the ink jet printing apparatus generally executes recovery processes in order to prevent blockage or an increase in viscosity of the ink or to resolve it if it actually occurs, thereby keeping the ink ejection performance of the printing head of an acceptable quality.

One of these recovery processes is a capping operation, which uses a cap to cover a surface of the printing head in which the ejection openings are formed while no printing operation is performed or in other cases. When no ink is ejected, for example, when no printing operation is performed, a certain amount of ink located close to the ejection openings may be more viscous or in an extreme case, may be dried and solidified, owing to evaporation of an ink solvent associated with the temperature, humidity, or the like of the environment in which the apparatus is located. Such an increase in viscosity of the ink may cause inappropriate ejection such as a reduced amount of ejection or deflected or hindered ejection, thereby reducing print grade. The capping operation prevents such a phenomenon.

Another recovery process is a so-called suction recovery process, which forcibly removes extremely viscous ink causing blockage, solidification, or the like. More specifically, the above-described cap is contacted to the surface of the printing head on which the ejection openings are disposed, and a pump or the like is used to reduce the pressure in the cap to discharge the more viscous ink via the ejection openings. In this respect, the pumping system is roughly classified into two types. One type is a cylinder type in which a piston is moved to generate a relatively high negative pressure. The other type is a tube pump type in which a roller is used to squeeze a tube so that the restoring force of the tube induces negative pressure.

As a further recovery process, a so-called preliminary ejection is known. During printing, ink may not be ejected through all the ejection openings, and, depending on printing data, no ink may be ejected through some of the ejection openings for some time. In these ejection openings, ink further becomes more viscous because no ejection is performed and viscous ink is not removed. To prevent this situation, the preliminary ejection is carried out so that ink is ejected into a cap or the like through all or some of the ejection openings in the printing head to refresh the interior of the ejection openings, for example, every specified lapse of time or each time a specified amount of printing is executed. If ink is preliminarily ejected into the cap, then the above-described pump is actuated to suck and discharge the ink from the cap when the amount of preliminarily-ejected ink reaches a certain value.

In addition to the above-described recovery processes using the cap, known recovery processes include a wiping process of using a blade to wipe the surface of the printing head on which the ejection openings are disposed.

Paper dust or other dust from a printing paper located opposite the printing head, or ink mist resulting from ink ejected onto and bouncing off the printing paper, may stick to the surface of the printing head on which the ejection openings are disposed. In this case, when such paper dust or ink mist stick to the fine ejection openings, ink cannot be ejected or is inappropriately ejected. To prevent ink from being inappropriately ejected, a wiping operation is performed by contacting the blade against the ejection opening-disposed surface of the printing head to wipe the surface at predetermined timings during printing, for example, after a specified time has passed or a specified amount of printing has been carried out. This enables removal of the paper dust or ink mist sticking to the above-mentioned surface. The wiping operation is also performed in response to a user's instruction operation if the user observes a printed image degraded as a result of inappropriate ejection.

Further, the wiping operation can be associated with the other recovery processes described above. That is, in the above-described preliminary ejection or suction recovery process, ink is ejected into the cap, or with the cap contacted to the ejection opening-disposed surface the printing head, the pressure in the cap is reduced for suction. Thus, after these recovery processes, the ink may remain stuck to the cap. Then, during the next recovery process, the cap, to which the ink remains stuck, is contacted to the ejection opening-disposed surface of the printing head to transfer the ink to this surface. Because of this, the wiping operation is also performed after the printing head is released from contact of the cap.

The construction of the printing head, the direct object of the above-described recovery process, needs to be adapted to the recent increased grade of printed images, for example, the increased density of black characters or the like, introduction of multiple colors, increased definition (resolution), improved waterproofness, and the like.

In general, serial system-based ink jet printing apparatuses have a printing head mounted on a carriage so that in response to the reciprocation of the carriage, ink is ejected from the printing head to form dots on printing paper for printing. With this system, a printing head that inexpensively meets requirements for an increase in printing grade is preferred for use in ejecting black ink to react with other color inks to insolubilize these inks, and has dense arrays of ejection openings. An example of such a construction is shown in FIG. 8.

FIG. 8 is illustration schematically showing the surface of the printing head on which the ejection openings are disposed. As shown in this figure, a printing head 7 has an ejection opening array 23 for black (Bk) ink, an ejection opening array 24 for yellow (Y) ink, an ejection opening array 25 for magenta (M) ink, and an ejection opening array 26 for cyan (C) ink, which are arranged parallel with one another in a scanning direction of the printing head 7. In this figure, for illustrative simplification, the individual ejection openings are not shown, but each array of a plurality of ejection openings is shown as a line. This is applicable to the subsequently-described figures.

The pitch between the ejection openings in each ejection opening array is equivalent to 600 dpi (dots per inch) for increased resolution or 1200 dpi for further increased resolution. The pitch between the ejection opening arrays is also tending to be decreased in order to reduce the size of the printing head and thus the apparatus. Further, the array width of the group of ejection opening arrays for the respective inks is about 3.5 mm, corresponding to a relatively dense construction.

As a construction of a printing head that meets the requirements for high-grade printing, in view of improving waterproofness or of preventing bleeding between the colors, the printing head is known which uses inks, for example, in which chemical reaction occurs between black ink and other color inks to make dyes or the like insoluble. For example, the black ink is cationic, whereas the other color inks are anionic. This causes the black ink and the other color inks for printing a black character or the like to be ionically coupled together to make color materials such as dyes insoluble, thereby improving the waterproofness of printed black characters or the like. Further, this can prevent bleeding between a black printed area and a color printed area.

However, when the printing head, in which the ejected black ink and other color inks are made insoluble through mixture as described above, is one of a reduced size, a pitch between the ejection opening array for black ink and the ejection opening arrays for the other color inks becomes small, and then the following problems may occur with a wiping operation using a blade as described previously.

As described previously, to prevent ink from being inappropriately ejected as a result of ink mist or the like sticking to the ejection opening-disposed surface of the printing head, a wiping operation is performed using a blade. FIGS. 9A and 9B are schematic illustrations showing a conventional example of an arrangement for wiping. As shown in these figures, a single blade 27 is moved in the direction in which the ejection opening array for each color extends, to perform a wiping operation. This is to prevent the black ink and other color inks, which react with each other to be made insoluble, from being mixed together as a result of the wiping operation. More specifically, this prevents a part of the blade 27 which wipes the ejection opening array 23 for the black ink from overlapping parts thereof which wipe the ejection opening arrays 24, 25, and 26 for the other color inks.

However, even with this construction, when the ejection opening-disposed surface of the printing head is wiped using the single blade 27, both the black ink and the other color inks may be brought to the center of the blade and mixed together as the blade 27 is moved, as shown by reference numeral 28 in FIGS. 9A and 9B. Consequently, reaction may occur to generate insoluble matter, or the black ink may enter the ejection openings of the color inks or, conversely, the color inks may enter the ejection openings of the black ink. As a result, the insoluble matter may stick to the vicinity or inside of the ejection openings, which are then blocked and ink may be inappropriately ejected or may not be ejected therethrough.

For example, Japanese Patent Application Laid-open No. 7-223321 (1995) describes a wiping construction that prevents inks of different colors from being brought together and mixed in the center of the blade as shown in FIGS. 9A and 9B. That is, this document describes the provision of a plurality of blades, each corresponding to one of the ejection opening arrays for the respective colors. More specifically, for a printing head in which the ejection opening arrays for the respective colors are arranged to form one line, which differs from the ejection opening arrays shown in FIG. 8, a blade is provided for each ejection opening array and is composed of two blade parts arranged so as to be V-shaped and to have an overlapping portion so that wiped-away ink is moved toward a narrower part of the V shape. This enables wiped-away inks to be moved to their respective locations where they are not mixed together.

However, such a wiping construction has an arrangement in which wiping of the blade is executed in a direction perpendicular to each ejection opening array in such a manner as to cover all the ejection openings, so that the "V" shape of the blade must have an overlapping portion in the wiping direction as described above. Thus, certain amounts of inks moved toward the center (in this document, inks of the same color) may be mixed together. Further, if the blade described in the document is to be applied to a printing head having ejection opening arrays such as those shown in FIG. 8, the ejection opening arrays 23 to 26 for the respective colors are each provided with the V-shaped blade, so that the space between the ejection opening arrays is too large to reduce the size of the printing head.

SUMMARY OF THE INVENTION

The object of the present invention is to provide an ink jet printing apparatus and a wiping method therefor which enable the size of a printing head to be reduced and in which upon wiping an ejection opening-disposed surface of a printing head integrated with ejection openings through which inks that react with each other to be made insoluble are ejected, ink wiped away from a certain ejection opening array is prevented from affecting the other ejection opening arrays.

In the first aspect of the present invention, there is provided an ink jet printing apparatus using a printing head having ejection openings for a plurality of inks disposed on a common-ejection opening-disposed surface, the plurality of inks reacting with each other to be made insoluble, to eject inks from the printing head onto a printing medium for performing printing, the ink jet printing apparatus comprising:

holding means for holding blades provided correspondingly to the respective ejection openings of the plurality of inks so that the blades respectively form a predetermined angle of 0° or larger with respect to a direction perpendicular to a direction of a movement of the blades for wiping and have a predetermined space between the blades in an area corresponding to the ejection openings for the plurality of inks; and wiping operation means for causing the holding means to move relatively to the printing head so that the blades wipe parts of the ejection opening-disposed surface on which the corresponding ejection openings are disposed, respectively.

Here, a blade may be further provided to wipe the ejection opening-disposed surface between the ejection openings for the plurality of inks, and the holding means may hold the additional blade behind the blades forming the predetermined angle relative to the movement direction.

In the second aspect of the present invention, there is provided a wiping method for an ink jet printing apparatus using a printing head having ejection openings for a plurality of inks disposed on a common ejection opening-disposed surface, the plurality of inks reacting with each other to become insoluble, to eject inks from the printing head onto a printing medium for performing printing, the method comprising the steps of:

providing holding means for holding blades provided correspondingly to the respective ejection openings of the plurality of inks so that the blades respectively form a predetermined angle of 0° or larger with respect to a direction perpendicular to a direction of a movement of the blades for wiping and have a predetermined space between the blades in an area corresponding to the ejection openings for the plurality of inks;

causing the blades provided correspondingly to the respective ejection openings of the plurality of inks to wipe parts of the ejection opening-disposed surface on: which corresponding ejection openings are disposed, respectively; and subsequently causing a blade provided correspondingly to the ejection opening-disposed surface between the ejection openings for the plurality of inks to wipe the surface.

According to the above construction, blades are provided for respective ejection openings of respective plurality of inks that react with each other to be made insoluble, so that each of the blades forms a predetermined angle of 0° or larger with respect to a direction perpendicular to a direction of the movement thereof during wiping and have a space of a predetermined size therebetween in an area corresponding to the plurality of ejection openings, and are used for wiping the ink or the like from the respective ejection opening-disposed surface. Accordingly, certain amounts of inks from the ejection opening arrays which have failed to be wiped away by the corresponding blades may remain on the ejection opening-disposed surface, but at the respective positions corresponding to one end of each of the blades, which have the space of the predetermined size formed therebetween. At these positions, the inks are essentially not mixed together.

Further, the remaining inks or the like, that is, the inks present on the ejection opening-disposed surface between the ejection openings for the inks with the different characteristics for the above-mentioned reaction, or the like, may be wiped away by a blade provided to wipe the ejection opening-disposed surface.

DETAILED DESCRIPTION OF PREFERRED EMBODIMENTS

Embodiments of the present invention will be described below in detail with reference to the drawings.

(Embodiment 1)

Figure 1:
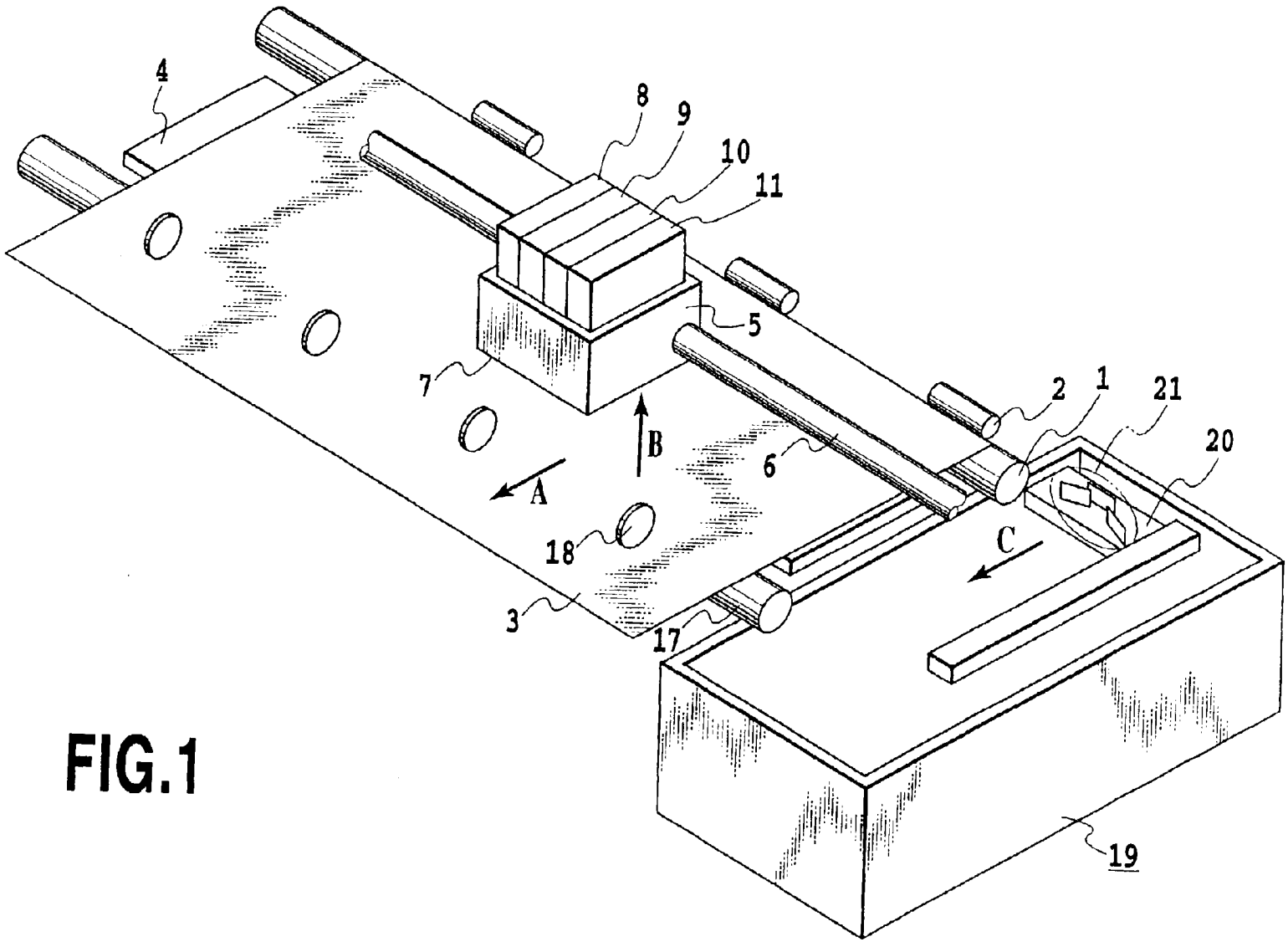
FIG. 1 is a perspective view schematically showing the construction of an essential part of an ink jet printer according to an embodiment of the present invention.

FIG. 1 is a perspective view schematically showing an essential part of an ink jet printer according to an embodiment of the present invention.

In FIG. 1, a sheet 3 as a printing medium fed by an auto sheet feeder, not shown, is transported on a platen 4 by a sheet feeding roller 1 and a pinch roller 2 that is in pressure contact with the sheet feeding roller 1, and a sheet discharging roller 17 and spurs 18, which are all rotated by driving force transmitted by a sheet feeding motor, not shown. In the figure, a mechanism that rotatably supports the spurs 18 is omitted.

A printing head 7 mounted on a carriage 5 forms a scanning range between the transportation roller 1 or the like and the sheet discharging roller 17 or the like. That is, the carriage 5, to which driving force from a carriage motor, not shown, is transmitted via a belt, not shown, is moved in a main-scanning direction substantially perpendicular to the direction in which the sheet 3 is fed, while being guided along a carriage shaft 6. During this moving operation, ink is ejected downward (in the figure) from the printing head 7 through ejection openings for the respective color inks on the basis of print data to print characters, images, or the like. More specifically, the carriage 5 has the printing head 7, integrated with the ejection openings for the respective color inks, mounted thereon, and has an ink tank 8 for black (Bk) ink, an ink tank 9 for yellow ink, an ink tank 10 for magenta (M) ink, and an ink tank 11 for cyan (C) ink all mounted above the printing head 7. In this embodiment, the printing head 7 uses thermal energy generated by a heater composed of an electro-thermal converter to generate a bubble in ink so that the pressure of the bubble causes the ink to be ejected.

A recovery unit 19 is provided outside the scanning range, but within the range within which the printing head 7 can move. The recovery unit 19 comprises a cap and a pump that sucks ink via the cap as described previously in the description of the prior art. Further, the recovery unit 19 is provided with a wiping mechanism for wiping an ejection opening-disposed surface of the printing head 7 on which the ejection openings are disposed. The carriage 5 moves to the position of the recovery unit 19, for example, before the start of printing or at predetermined time intervals during printing, to execute a suction recovery process, a preliminary ejection process, and/or a wiping process, as described previously.

A wiping mechanism of this embodiment comprises a group of blades 21 composed of two blades arranged so as to form a V shape that becomes wider in the wiping direction and to have no overlapping portion, and a blade extending in a direction perpendicular to the wiping direction, as well as a blade holder 20 which holds the group of blades and which can move in the wiping direction (shown by arrow C in the figure) and in the opposite direction. During wiping, the blade holder 20 is moved in the direction of the arrow C by a recovery system motor, not shown, to allow the group of blades 21 to wipe the surface of the printing head 7 on which the ejection openings are disposed, as described later with respect to FIG. 3.

Figure 2:
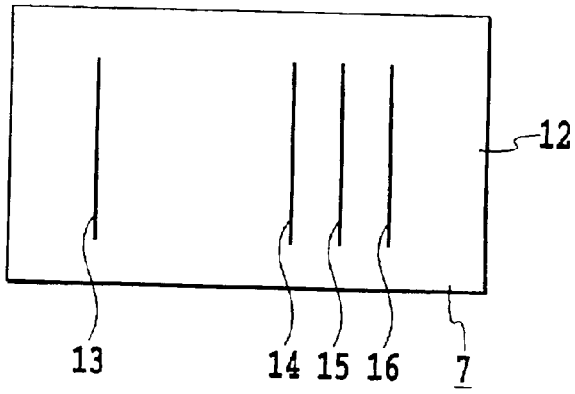
FIG. 2 is an illustration showing an arrangement of ejection opening arrays for the respective colors on an ejection opening-disposed surface of the printing head, as viewed in the direction of arrow B in FIG. 1.

FIG. 2 schematically shows the surface 12 (ejection opening-disposed surface) of the printing head 7 on which the ejection opening arrays for the respective ink colors are disposed, as viewed in the direction of the arrow B in FIG. 1. As shown in FIG. 2, an ejection opening array 13, through which the Bk ink is ejected, and the ejection arrays 14, 15, and 16, through which respective color inks are ejected, are arranged so that the space between the ejection opening array 13 and the leftmost array 14 of the ejection arrays 14, 15, and 16 is larger than the space between the ejection arrays 14 and 15 or arrays 15 and 16. In this case, the Bk ink ejected through each ejection opening of the ejection opening array 13 uses pigment as coloring material and is cationic. On the other hand, the Y, M, and C inks ejected from the ejection opening arrays 14, 15, and 16, respectively, use dye and are anionic. When mixed together, these cationic and anionic inks react with each other to become insoluble.

In this embodiment, when a black image such as a black character is printed, the cyan ink is ejected together with the black ink to make the black ink insoluble in order to improve the waterproofness and density of the printed image. In this respect, ejection data for the cyan ink need not be the same as ejection data for the black ink, but may be obtained by, for example, thinning the ejection data for the black ink at a specified rate.

Figure 3:
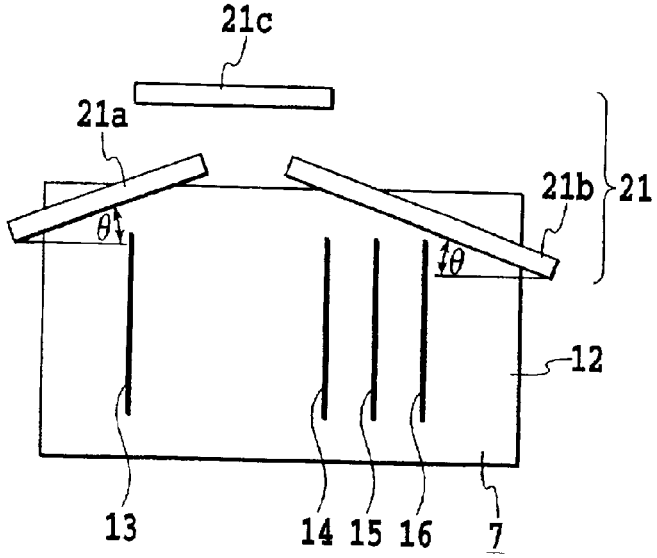
FIG. 3 is an illustration explaining a relationship between each blade of a blade group and the ejection opening-disposed surface in the ink jet printer shown in FIG. 1, as observed during a wiping operation using the blade group.

FIG. 3 is an illustration explaining specifically the relationship between each blade of the group of blades and each of the ejection opening arrays observed when the surface on which the ejection opening arrays shown in FIG. 2 are disposed is wiped.

As shown in FIG. 3, a blade 21*a* and blade 21*b* of the group of blades 21 are arranged so as to be V-shaped relative to the ejection opening arrays during wiping and to have a predetermined distance therebetween so as not to overlap each other. More specifically, the blades 21*a* and 21*b* carry out wiping while maintaining a fixed angle θ relative to a direction perpendicular to the ejection opening arrays. The blade 21*a* wipes a portion of the ejection opening-disposed surface 12 on which the ejection opening array 13 is disposed, whereas the blade 21*b* wipes a portion of the ejection opening-disposed surface on which the ejection opening arrays 14, 15, and 16 are disposed. Thus, each accumulation of wiped-away ink moves downward in the figure, while moving toward one end of the blade 21*a* or 21*b*. As a result, part of each accumulation of ink leaves the blade 21*a* or 21*b* in a relatively large central portion or region between the ejection opening array 13 and the group of ejection opening arrays 14, 15, and 16 and at a position corresponding to the above one end of each blade. Then, the ink leaving the blades 21*a*, 21*b* is wiped away by a blade 21*c* extending in the direction orthogonal to the ejection opening arrays and disposed behind the blades 21*a* and 21*b*.

As described above, according to this embodiment, part of the reactive ink may leave the corresponding blade and remain in the central portion, but the positions at which the respective accumulations of ink leave the corresponding blades are separate from each other correspondingly to the end of each of the blades, so that the inks are unlikely to be mixed with each other. Further, depending on the amount of ink wiped away or the distance between the ejection opening array 13 and the terminal array 14 of the group of ejection opening arrays 14, 15, and 16, the inks may be likely to contact or mix with each other to become insoluble. However, immediately after the contact, the blade 21*c*, corresponding to the central portion between the ejection opening array 13 and the group of ejection opening arrays 14, 15, and 16, wipes away the inks, which can thus be excluded from the ejection opening-disposed surface 12. Further, the blade need not be provided for each ejection opening array, thereby simplifying the wiping construction.

The material for each blade of the group of blades 21 is desirably urethane, HNBR, EPDM, or the like.

(Embodiment 2)

This embodiment is constituted substantially similarly to Embodiment 1, described above, but differs therefrom in the number of blades.

Figure 4:
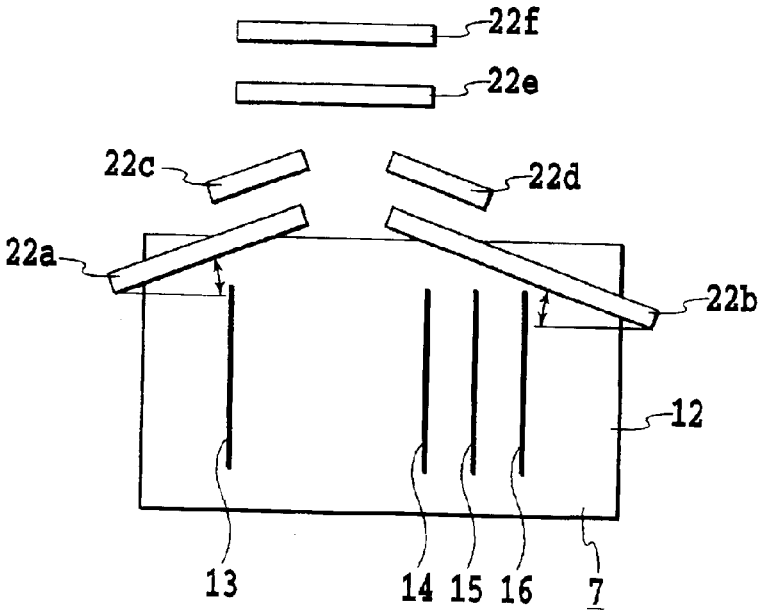
FIG. 4 is an illustration explaining a relationship between each blade of a blade group and the ejection opening-disposed surface, as observed during a wiping operation using the blade group according to a second embodiment of the present invention.

For example, to deal with the case in which the reaction between the Bk ink and the other color inks is more intense than that in Embodiment 1, described above, the group of blades includes six blades as shown in FIG. 4. The group of blades include blades 22*a* and 22*c* corresponding to the ejection opening array 13 for the Bk ink and blades 22*b* and 22*d* corresponding to the ejection opening arrays 14, 15, and 16 for the color inks. That is, if the reaction is intense, the inks react easily with each other even with a small amount of contact or the like and become correspondingly more markedly insoluble. Accordingly, if the inks already react with each other to be made slightly insoluble during wiping, they are difficult to wipe away even with the blades. Thus, a pair of smaller V-shaped blades 22*c* and 22*d* are provided behind the larger first V-shaped blades 21*a* and 21*b*, respectively. This construction serves to scrape off inks remaining on the ejection opening-disposed surface 12 and which react easily with each other and are easily made insoluble. In addition, two blades 22*e* and 22*f* extending in the orthogonal direction are further provided for final wiping.

(Embodiment 3)

Figure 5:
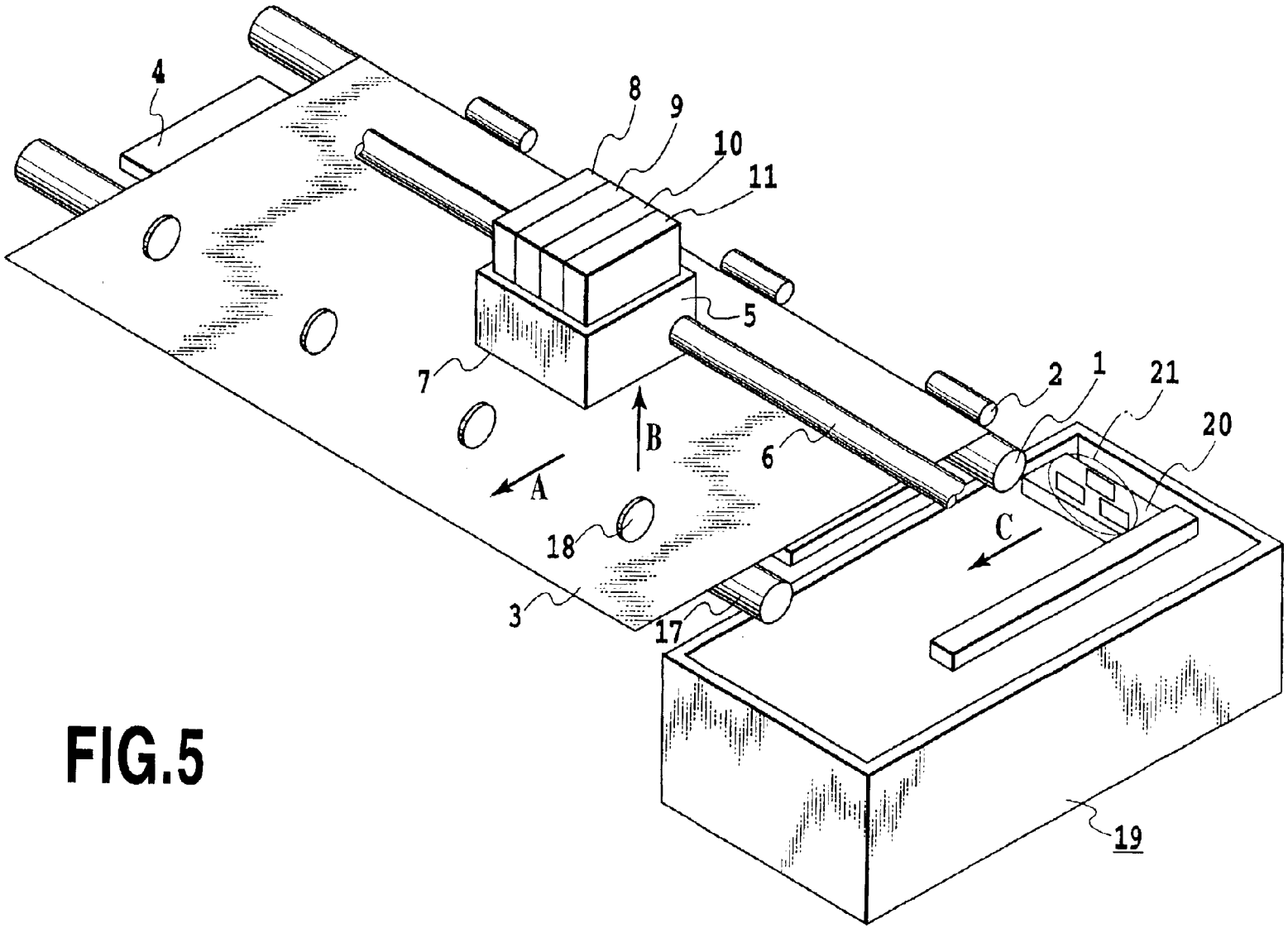
FIG. 5 is a perspective view schematically showing the construction of an essential part of an ink jet printer according to another embodiment of the present invention.

FIG. 5 is an illustration showing an ink jet printer according to a third embodiment of the present invention, and is similar to FIG. 1. This embodiment differs from Embodiment 1 in that the blades constituting the group of blades 21 extend parallel with the direction orthogonal to the wiping direction.

Thus, as shown in Embodiments 1 and 2, described above, the present invention is applicable not only to the case in which each of the blades forms the predetermined angle θ with respect to the direction orthogonal to the wiping direction, but also to the case the angle θ=0. With this angle, an amount of ink moving toward one end of the corresponding blade decreases compared to Embodiments 1 and 2, thereby reducing the amounts of Y, M, and C color inks mixed together.

Figure 6:
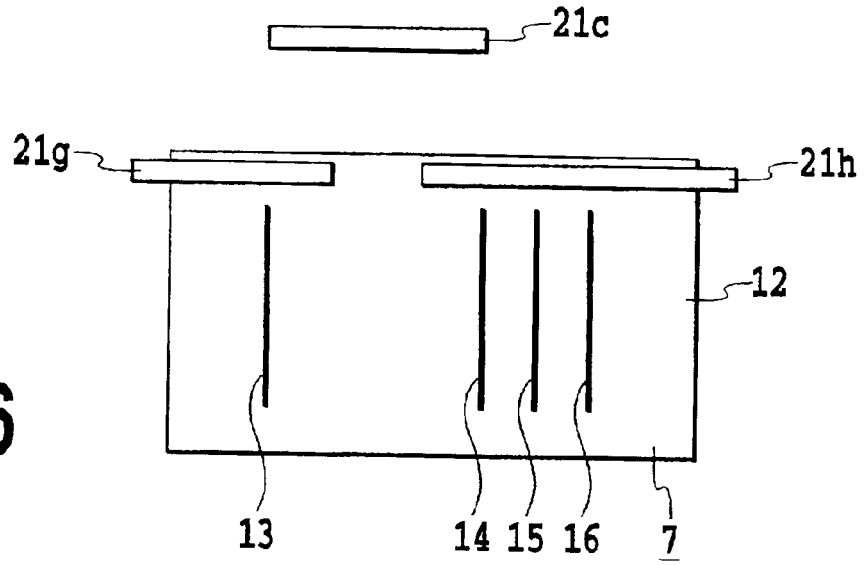
FIG. 6 is an illustration explaining a relationship between each blade of a blade group and the ejection opening-disposed surface in the ink jet printer shown in FIG. 5, as observed during a wiping operation using the blade group.

FIG. 6 is an illustration showing an arrangement of the group of blades 21 according to this embodiment. As shown in this figure, blades 21*g* and 21*h* of the group of blades 21 extend parallel with the direction orthogonal to the ejection opening arrays, and have a predetermined distance therebetween so as not to overlap each other.

(Embodiment 4)

Figure 7:
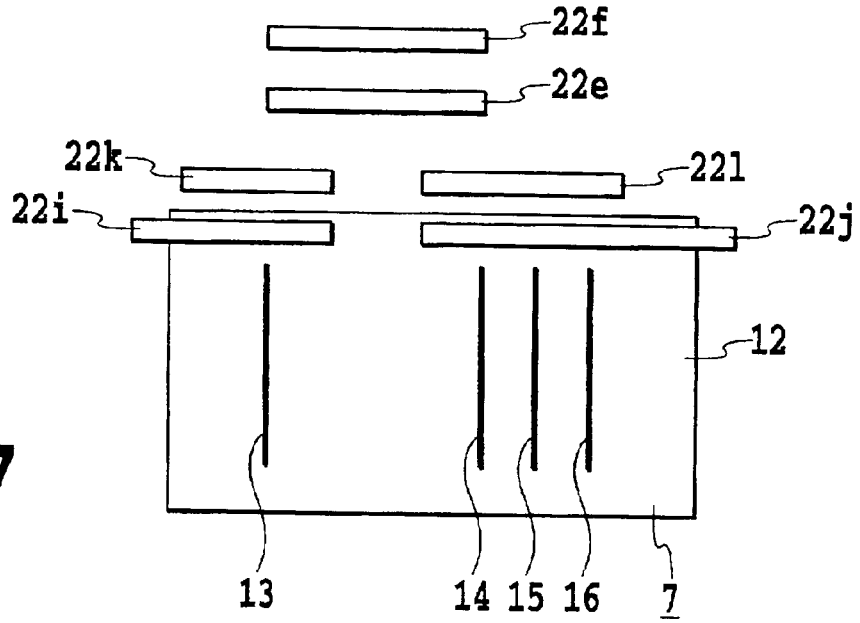
FIG. 7 is an illustration explaining a relationship between each blade of a blade group and the ejection opening-disposed surface, as observed during a wiping operation using the blade group according to a fourth embodiment of the present invention.
Figure 8:
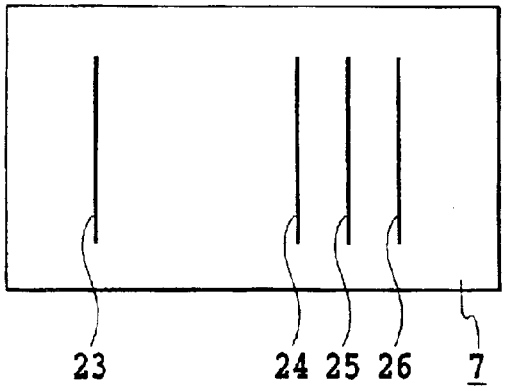
FIG. 8 is an illustration showing an arrangement of ejection opening arrays on an ejection opening-disposed surface of the conventional printing head.
Figure 9A:
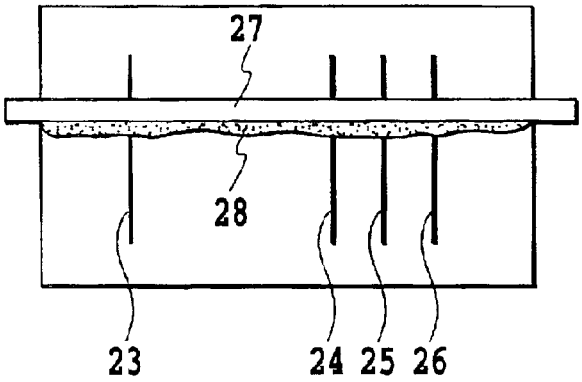
FIGS. 9A and 9B are plan and side views showing the relationship between blades in a conventional ink jet printing apparatus and the printing head, as observed during a wiping operation using these blades.
Figure 9B:
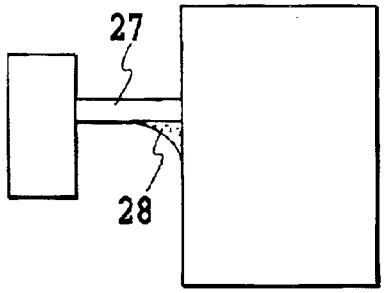

FIG. 7 is an illustration showing an arrangement of the group of blades 21 according to a fourth embodiment of the present invention. The blades extend parallel with the direction orthogonal to the ejection opening arrays as in Embodiment 3, described above, and the plurality of blades is provided as in Embodiment 2, described above.

As shown in this figure, the group of blades includes six blades. The group of blades includes blades 22*i* and 22*k* corresponding to the ejection opening array 13 for the Bk ink and blades 22*j* and 22*l* corresponding to the ejection opening arrays 14, 15, and 16 for the color inks.

(Other Embodiments)

In the above-described embodiments, each blade of the pair of blades is inclined at the same angle, but the application of the present invention is not limited to this aspect. For example, one blade of the pair of blades may be inclined at 0°, whereas the other blade may be inclined at a predetermined angle that is not 0°.

As is apparent from the above description, according to the embodiments of the present invention, blades are provided for respective ejection openings of a plurality of inks that react with each other to be made insoluble, so that each blade forms a predetermined angle of 0° or greater with respect to a direction perpendicular to a direction of movement thereof during wiping and the blades have a space of a predetermined size therebetween in an area corresponding to a space between the plurality of ejection openings, and are used for wiping the ink or the like from the ejection opening-disposed surface. Accordingly, certain amounts of ink from the ejection opening arrays which have failed to be wiped away by the corresponding blades may remain on the ejection opening-disposed surface, but at the respective positions corresponding to one end of each of the blades, which have the space of the predetermined size formed therebetween. At these positions, the inks are essentially not mixed together.

Further, the remaining inks or the like, that is, the inks present on the ejection opening-disposed surface between the ejection openings for the inks with the different characteristics for the above-mentioned reaction, or the like, may be wiped away by a blade provided to wipe the ejection opening-disposed surface.

As a result, a reliable ink jet printing apparatus is provided which has a particularly compact construction and which prevents reactive ink wiped away from one of the ejection opening from affecting the other ejection opening to prevent hindered or inappropriate ejection as a result of wiping.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. An ink jet printing apparatus using a printing head having ejection openings for a plurality of inks disposed on a common ejection opening-disposed surface, the plurality of inks reacting with each other to become insoluble, to eject inks from the printing head onto a printing medium for performing printing, said ink jet printing apparatus comprising:

a holder for holding blades provided correspondingly to the respective ejection openings of the plurality of inks so that the blades respectively form a predetermined angle of 0° or larger with respect to a direction perpendicular to a direction of a movement of said blades for wiping and have a predetermined space between said blades in an area corresponding to a region of the common ejection opening-disposed surface between the ejection openings for the plurality of inks, and an additional blade to wipe the region of the ejection opening-disposed surface between the ejection openings for the plurality of inks; and operation means for effecting relative movement between said holder and the printing head so that the blades wipe parts of the ejection opening-disposed surface on which the corresponding ejection openings are disposed, respectively, and so that the additional blade wipes the region of the ejection opening-disposed surface between the ejection openings for the plurality of inks.

2. An ink jet printing apparatus as claimed in claim 1, wherein the predetermined angle of each of the blades provided correspondingly to the ejection openings for the plurality of inks is not 0°.

3. An ink jet printing apparatus as claimed in claim 1, wherein the predetermined angle of each of the blades provided correspondingly to the ejection openings for the plurality of inks is 0°.

4. An ink jet printing apparatus as claimed in claim 1, wherein said holder holds the plurality of blades correspondingly to the ejection openings for the plurality of inks, respectively.

5. An ink jet printing apparatus as claimed in claim 1, wherein said holder holds the additional blade so that the additional blade extends in a direction orthogonal to the direction of the movement.

6. An ink jet printing apparatus as claimed in claim 1, wherein the plurality of inks include black ink and other color inks.

7. An ink jet printing apparatus as claimed in claim 1, wherein each of the ejection openings for the plurality of inks forms an array of a plurality of ejection openings, and a direction in which each array extends coincides with the direction of the movement.

8. An ink jet printing apparatus as claimed in claim 1, wherein the printing head uses thermal energy to generate a bubble in the ink so that a pressure of the bubble causes the ink to be ejected.

9. A wiping method for an ink jet printing apparatus using a printing head having ejection openings for a plurality of inks disposed on a common ejection opening-disposed surface, the plurality of inks reacting with each other to become insoluble, to eject inks from the printing head onto a printing medium for performing printing, said method comprising the steps of:

providing blades disposed correspondingly to the respective ejection openings of the plurality of inks so that the blades respectively form a predetermined angle of 0° or larger with respect to a direction perpendicular to a direction of a movement of the blades for wiping and have a predetermined space between the blades in an area corresponding to a region of the common ejection opening-disposed surface between the ejection openings for the plurality of inks and an additional blade for wiping the region of the ejection opening-disposed surface between the ejection openings for the plurality of inks;

causing the blades provided correspondingly to the respective ejection openings of the plurality of inks to wipe parts of the ejection opening-disposed surface on which the corresponding ejection openings are disposed, respectively; and subsequently causing the additional blade to wipe the region of the ejection opening-disposed surface between the ejection openings for the plurality of inks.

* * * * *